US005102782A

United States Patent [19]

LeStrange

[11] Patent Number: 5,102,782

[45] Date of Patent: * Apr. 7, 1992

[54] PHOTOGRAPHIC FILM WITH IMPROVED SPEED TO FOG RATIO

[75] Inventor: Raymond J. LeStrange, Hendersonville, N.C.

[73] Assignee: E. I. Du Pont de Nemours and Company, Wilmington, Del.

[ * ] Notice: The portion of the term of this patent subsequent to Oct. 23, 2007 has been disclaimed.

[21] Appl. No.: 625,971

[22] Filed: Dec. 11, 1990

[51] Int. Cl.[5] ..... G03C 1/08; G03C 1/34

[52] U.S. Cl. ..... 430/599; 430/603; 430/607; 430/608

[58] Field of Search ..... 430/599, 603, 607, 608

[56] References Cited

U.S. PATENT DOCUMENTS 3,650,759 3/1972 Sonoda et al. ..... 430/607

4,965,184 10/1990 LeStrange ..... 430/603

*Primary Examiner*—Charles L. Bowers, Jr.

*Assistant Examiner*—Janet C. Baxter

[57] ABSTRACT

Photographic, gelatino, silver halide emulsions exhibiting improved speed/fog ratio and good hardening are described. These emulsions are made by sensitizing with 1-naphthol-4-sulfonic acid and by adding an aliphatic polyol thereto.

4 Claims, No Drawings

PHOTOGRAPHIC FILM WITH IMPROVED SPEED TO FOG RATIO

CROSS REFERENCE TO RELATED APPLICATIONS

This application is related to my previously filed application, U.S. Ser. No. 07/314,199 and now U.S. Pat. No. 4,965,184 filed Feb. 23, 1989 which describes the addition of 1-naphthol-4-sulfonic acid as a chemical sensitizer to a photographic, gelatino, silver halide emulsion and is an improvement thereover.

FIELD OF THE INVENTION

This invention relates to the sensitization of gelatino, silver halide emulsions and to a method for improving the speed/fog ratio of said emulsions. Still more particularly, this invention relates to the addition of an aliphatic polyol to improve said speed/fog ratio.

BACKGROUND OF THE INVENTION

In my previously filed application (U.S. Ser. No. 07/314,199) and now U.S. Pat. No. 4,965,184 the use of 1-naphthol-4-sulfonic acid to improve the sensitization of a gelatino, silver halide emulsion is described. This compound is unusual in and of itself for use as such a sensitizer. Prior art sulfonic acids did not accomplish this increase in speed. The use of a chemical sensitizer usually results in a concurrent increase in emulsion fog and thus it is conventional to add an antifoggant or stabilizer to control this fog. The use of the latter compounds, although efficacious, usually results in a long term speed loss for the film element. Thus, there have been a continuing effort to find compounds or combinations of compounds which not only result in a higher level of sensitization but which will reduce the amount of fog generated.

SUMMARY OF THE INVENTION

It is an object of this invention to sensitize gelatino, silver halide emulsions without generating excess fog. These and yet other objects are achieved by formation of a photosensitive element having at least one photosensitive silver halide emulsion layer containing a sensitizing amount of an alkali metal salt of 1-napthol-4-sulfonic acid in a concentration of from 1 to 20 grams per 1.5 moles of silver halide present, wherein the improvement comprises said emulsion containing an aliphatic polyol wherein the speed to fog ratio of said element is improved.

DETAILS OF THE INVENTION

The use of 1-napthol-4-sulfonic acid and the alkali metal salts thereof is fully described in the aforementioned application, the substance of which is incorporated herein by reference. This material can be added to gelatino, silver halide emulsion in amounts ranging from 1 to 20 gm/1.5 mole of silver halide present, with 2 to 8 gm/1.5 mole of silver halide being preferred. The addition of this sensitizer will result in an increase of emulsion speed. However, some increase in emulsion fog has also been noted.

The emulsions useful within the ambit of this invention include all of the common silver halides including silver bromide, silver iodide and silver chloride or mixtures of two or more of these halides. A particularly preferred emulsion is one of ca. 98 mol % bromide and ca. 2 mol % iodide with fairly large grains. These grains can be any of the commonly known grains such as cubic, rhombic, tetrahedral and tabular shapes, for example. They can be used in any of the well-known systems such as in graphic arts, cine, X-ray etc. They may be either positive or negative working systems and the method for producing such elements is well-known to those of normal skill in the art.

These emulsions can also contain other sensitizers in addition to the 1-napthol-4-sulfonic acid. The chemical sensitizers with labile sulfur are well-known, for example, and include thiosulfates, thiocyanates, thionex, etc. Metal salts such as gold and mercury salts may also be present if required. The usual antifoggants, stabilizers, antistatic agents, hardeners, coating and wetting aids, etc., may also be present as well as dyes to improve the sensitivity of the emulsion to different wave lengths.

The organic polyols of this invention are aliphatic and particularly aliphatic polyols containing from 3 to 10 carbon atoms. Examples include 1,2,6-trihydroxyhexane; trimethyolpropane; 1,4-butanediol; 1,5-pentanediol; 1,2-hexanediol; 1,6-hexanediol; and 1.9-nonanediol. These polyols can be added to the emulsion in amounts ranging from 0.5 to 20 gm/1.5 moles of silver halide and preferably in amounts ranging from 2 to 10 gm/1.5 moles of silver halide. They can be added at any time during the emulsion making process but I prefer adding them directly after the aforementioned chemical sensitization step and just prior to the coating of the emulsion on a suitable support. The addition of these aliphatic polyols also help to increase the hardening of the emulsion and lessen the need for additional conventional hardener. This fact helps in emulsion drying during the coating thereof and increases the melting point of the processed films made thereby.

Suitable supports include any of the prior art supports useful for photographic emulsions. Preferably, the support will be a dimensionally stable polyethylene terephthalate support on which will be coated a thin, organic, anchoring substratum followed by another substrate of gelatin. The support may contain other ingredients such a dyes or reflecting agents and alternate layers such as antistatic layers, antihalation layers, antiabrasion layers may also be present within the metes and bounds of this invention.

This invention will now be demonstrated by the following specific examples of which Example 1 is considered to be the best mode. All parts and percentages are by weight unless otherwise indicated.

EXAMPLE 1

A coarse grained, gelatino, silver halide emulsion of ca. 98 mol % bromide and ca. 2 mol % iodide was prepared. This emulsion was brought to its optimum sensitivity with gold and sulfur as is well-known to those skilled in the art. Then, it was split into eight (8) portions to which the following ingredients were added as shown in the Table below. Each portion also received a normal aliquot of antifoggants, stabilizers, hardeners, coating and wetting aides before being coated on a 7 mil, blue tinted, polyethylene terephthalate film support previously described above. Each coating was dried and sampled and each sample given a P45 phosphor screen exposure which is conventional for video imaging applications. The exposed films were developed, fixed, washed and dried in a conventional manner and the sensitometric results are shown in the Table below:

TABLE 1

| Compounds Added (gm/1.5 moles of Ag halide) | | Sensitometry | | | |
|---|---|---|---|---|---|
| 1-N-4-S | HXT | Speed | Gradient | B + F | Melt Pt. |
| 0 | 0 | 214 | 5.13 | .21 | 69 |
| 2 | 0 | 227 | 5.34 | .19 | 65 |
| 4 | 0 | 227 | 5.41 | .17 | 63 |
| 0 | 7.5 | 210 | 5.11 | .18 | 70 |
| 0 | 15.0 | 207 | 5.11 | .16 | 72 |
| 2 | 7.5 | 222 | 5.29 | .17 | 69 |
| 4 | 10.0 | 220 | 5.25 | .15 | 69 |

1-N-4-S is 1-Naphthol-4-Sulfonic Acid, Sodium Salt
HXT is 1,2,6-trihydroxyhexane As can easily be seen, the combination of ingredients gives the best emulsion sensitometry and the best speed/fog ratio.

EXAMPLE 2

In this example, the same emulsion described in Example 1 was used. This emulsion was split into nine (9) portions to which various aliphatic polyols were added. In addition, 4 gm/1.5 mole of silver halide of the sodium salt of 1-naphthol-4-sulfonic acid were also added. One (1) portion was kept as control (neither 1-N-4-S or an aliphatic diol added and one (1) portion had only the 1-N-4-S alone). Each sample was coated, overcoated, dried, exposed, developed, fixed, washed, dried and sampled as described in Example 1. The sensitometric results are shown in the following Table:

TABLE 2

| Compounds added | Amt | Sensitometry Speed | Gradient | B + F | Melt. Pt. |
|---|---|---|---|---|---|
| None - Control | | 230 | 3.24 | .20 | 60 |
| Only 1-N-4-S | | 235 | 3.30 | .19 | 55 |
| 1,2,6-Trihydroxy-hexane | 5 | 223 | 3.09 | .17 | 64 |
| Trimethyolpropane | 5 | 271 | 3.30 | .18 | 61 |
| 1,4-Butanediol | 10 | 239 | 3.08 | .18 | 58 |
| 1,5-Pentanediol | 10 | 248 | 3.11 | .17 | 56 |
| 1,2-Hexanediol | 10 | 231 | 3.02 | .17 | 60 |
| 1,6-Hexanediol | 10 | 228 | 3.35 | .17 | 55 |
| 1,9-Nonanediol | 10 | 262 | 3.32 | .19 | 60 |

What is claimed is:

1. In a photosensitive element having at least one photosensitive silver halide emulsion layer containing a sensitizing amount of an alkali metal salt of 1-naphthol-4-sulfonic acid in a concentration of from 1 to 20 grams per 1.5 moles of silver halide present, wherein the improvement comprises said emulsion containing an aliphatic polyol wherein the speed to fog ratio of said element is improved by the presence of said aliphatic polyol in said emulsion.

2. The photosensitive element of claim 1 wherein the polyol contains from 3 to 10 carbon atoms.

3. The element of claim 2 wherein said aliphatic polyol is taken from the group consisting of 1,2,6-trihydroxyhexane; trimethyolpropane; 1,4-butanediol; 1,5-pentanediol; 1,2-hexanediol; 1,6-hexanediol; and 1.9-nonanediol.

4. The element of claim 2 wherein said aliphatic polyol is present in a range of from 0.5 to 20 gm/1.5 mole of silver halide present.

* * * * *